US005793275A

United States Patent [19]

Iversen

[11] Patent Number: 5,793,275

[45] Date of Patent: Aug. 11, 1998

[54] EXOTHERMICALLY ASSISTED ARC LIMITING FUSES

[76] Inventor: Arthur H. Iversen, 15315 Sobey Rd., Saratoga, Calif. 95070

[21] Appl. No.: 735,201

[22] Filed: Oct. 21, 1996

Related U.S. Application Data

[60] Provisional application No. 60/005,797 Oct. 23, 1995.

[51] Int. Cl.[6] ..... H01H 85/38

[52] U.S. Cl. ..... 337/273; 337/296

[58] Field of Search ..... 337/273, 160, 337/401, 158, 159, 290, 279, 293, 295, 406, 296, 405, 30, 142, 416, 243, 404, 162, 58, 4, 415, 182, 183, 184, 185, 281, 283, 6, 17, 31, 170; 200/150 R, 61.08

[56] References Cited

U.S. PATENT DOCUMENTS 2,175,250 10/1939 Burrows et al. ..... 337/243
3,639,874 2/1972 Deelman ..... 337/185
4,331,947 5/1982 Noerholm ..... 337/159
5,262,750 11/1993 Gurevich ..... 337/273

*Primary Examiner*—Leo P. Picard
*Assistant Examiner*—Anatoly Vortman
*Attorney, Agent, or Firm*—Armstrong, Teasdale, Schlafly & Davis

[57] ABSTRACT

There is described a fuse comprising a housing and a current carrying strip of metal comprising a fuselink enclosed in the housing, each end of which electrically extends through the housing as an electrical connection. There being at least one first section of the metal strip for severing upon predetermined fault conditions, and at least one second section of the metal strip, distanced from the first section, having the properties of a hinge for pivoting. There further being at least one exothermic source in the proximity of the first section that substantially upon severance of the metal strip at the first section is ignited, and causes at least one segment of the severed metal strip to be propelled about the second section comprising the hinge. There further being an arc chute in proximity to the path of the moving severed edge of the first section such that fault current limiting is obtained.

20 Claims, 6 Drawing Sheets

A-A

EXOTHERMICALLY ASSISTED ARC LIMITING FUSES

RELATED APPLICATIONS

This application claims priority in part to Iversen, "Fast Acting, Arc Limiting Fuses", U.S. Provisional Patent Application Ser. No. 60/005,797, filed on Oct. 23, 1995.

BACKGROUND OF THE INVENTION

1. Field of Invention

The present invention relates to fuses used, for example, in connection with the generation, transmission, distribution and conversion of electric power, and in particular, addresses the need for fast acting, arc limiting fuses.

2. Related Art

In conventional fuses the most general form of fuselink is a strip of metal, such as copper or silver, having multiple narrowed segments or restricted sections. The higher resistance of the restricted sections, that is the smaller cross sections, causes the restricted sections to melt first under fault conditions. In conventional fuses, multiple restricted sections are employed to cause a sufficiently high voltage drop to be developed, after a suitable arcing time which is current dependent, to cause the arc to extinguish. To operate at higher voltages, for example, above 600V, fuses are long and require larger numbers of restricted sections to accommodate the higher voltages. This leads to high inductance making them of limited value for use in high frequency switch mode power systems, and particularly with power semiconductors. Furthermore, if the fault or overcurrent is small, for example, 1.5 to 1, compared to the continuous rating of the fuse, only one restriction may melt resulting in a long arcing period with potential equipment damage.

SUMMARY OF THE INVENTION

There is described a fuse comprising a housing and a current carrying strip of metal comprising a fuselink enclosed in the housing, each end of which electrically extends through the housing as an electrical connection. There being at least one first section of the metal strip for severing upon predetermined fault conditions, and at least one second section of the metal strip, distanced from the first section, having the properties of a hinge for pivoting. There further being at least one exothermic source in the proximity of the first section that substantially upon severance of the metal strip at the first section is ignited, and causes at least one segment of the severed metal strip to be propelled about the second section comprising the hinge. There further being an arc chute in proximity to the path of the moving severed edge of the first section such that fault current limiting is obtained.

By placing on the fuselink, a suitable exothermic propulsion charge on at least one side of the restricted section and preferably in close proximity thereto, a capability is provided to rapidly separate the two segments of the fuselink from each other upon a fault induced melting of the restricted section thereby clearing the fault. Upon arc initiation, a suitable fuse located in the restricted section is ignited and quickly ignites the exothermic propulsion charge. The exothermic charge acts as a propellant to drive each segment of the fuselink away from each other thereby creating a suitably large gap between the fuselink segments such that the arc cannot be maintained and is extinguished. Thus, the dielectric strength of the gap is such that the arc cannot re-strike. To further assist in extinguishing the arc and limit the current, the exothermic material may have mixed with it or placed near it, material that upon heating generates arc quenching gases, such as, electro-negative. Suitable materials include, for example, boric acid and aliphatic nitrogen and hydrogen producing materials. In addition, arc chutes, commonly only used in circuit breakers may be adapted to the substantially present invention to provide current limiting action.

The present invention provides a solution to the non-interrupting band which occurs between the rated fuse current and the minimum interruption current of conventional fuses. This is the region of low overcurrent, for example, 150% of the rated fuse current, where the arc does not clear within a specified time, but rather continues to arc with potential for fire, and damage and destruction of equipment. The arc clearing times of the present invention, whether currents are below the minimum interruption current or a heavy short circuit, are substantially the same because arc temperatures, which range from about 10,000° K to 15,000° K for any current, are more than adequate to ignite the exothermic propulsion material and so drive the two fuselink segments apart to clear the fault. If an arc is struck, the fault will clear no matter how low the current thus making arc clearing times independent of current. Pre-arcing characteristics of the present invention are substantially the same as for conventional fuses.

The fuse of the present invention provides for the rapid clearance of a fault upon initiation of an arc, the arc clearing time being substantially constant and independent of the fault current.

The fuse of the present invention enables lower minimum currents to be cleared and arc clearing times are substantially independent of power factor.

The fuse of the present invention is of inherently low inductance.

The fuse of the present invention is compact and capable of use at high voltages.

The fuse of the present invention is of low cost construction.

The fuse of the present invention provides for limiting of arc currents.

DETAILED DESCRIPTION OF THE INVENTION

Figure 1:
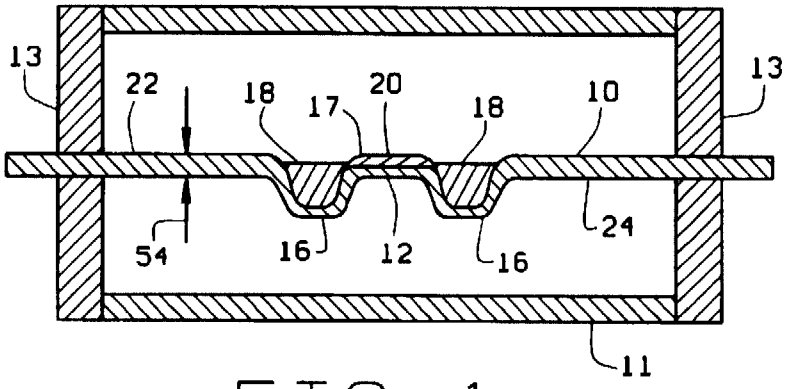
FIG. 1 is a side cross section view of a fuse with exothermic propulsion means mounted on the fuselink to separate the fuselink segments upon a fault condition.
Figure 2:
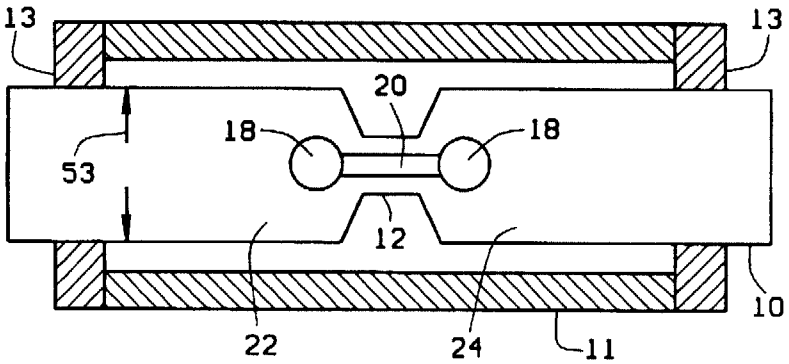
FIG. 2 is a top down cross section view of a fuse showing positioning of the exothermic propulsion means relative to the restricted section.

Referring now to FIGS. 1 and 2, shown is fuselink 10 having a least one fuselink 10 severance section 17, sometimes referred to as severance section, which is caused to melt under fault conditions creating a gap 26 (FIG. 3) in fuselink 10. Fuselinks 10 are generally strips of metal made of, for example, copper, silver or aluminum, alloys thereof or other suitable conductor material. Fuselink 10 is enclosed in an electrically insulating housing 11, made, for example, of glass, ceramic or plastic, with each end of the fuselink 10, protruding through end caps 13 for external electrical connections. End caps 13 may be of an electrically insulating material, or may be of metal. Fuselink 10 is shown in strip form. To cause severance of the fuselink in a predetermined section, called severance section 17, of the fuselink under fault conditions, the general method is to obtain a high resistivity in the severance section. In this manner $I^2R$ fault induced heating causes severance section 17 to melt first. Severance section 17 is illustrated as restricted section 12 which has a cross sectional area less than the main body, width 53 times thickness 54, of fuselink 10 resulting in a localized high electrical resistance. In close proximity to restricted section 12 and either fastened to fuselink 10 or an integral part of it, are containment wells 16 to hold exothermic material 18. For controlled ignition of material 18 a segment of a second exothermic fuse 20 may protrude into restricted section 12 such that upon a fault and consequent melting of section 12, and before or after striking of an arc between the two fuselink segments 22, 24, fuse 20 is ignited and the burning material quickly travels to ignite material 18. Alternatively, with exothermic material 18 in dose proximity to restricted section 12, material 18 can be ignited by the arc upon adequate burn-back of fuselink segments 22, 24.

The ignition temperature of exothermic materials 18 and 20 may be tailored to be above the melting point of restricted section 12 such that the ensuing arc ignites materials 18, 20. When employing the Metcalf effect, for example, with a strip of tin on the copper or silver fuselink 10, the melting point is reduced to about 230° C. Thus, materials 18, 20 ignition temperature would be set suitably above 230° C. For copper, aluminum or silver fuselinks 10, without the Metcalf effect, material 18, 20 ignition temperatures at or above the respective melting points of 1083° C., 660° C. and 962° C. are desirable. With arc temperatures ranging from about 10,000 to 15,000° K, substantially any ignition temperature for materials 18, 20 may be accommodated.

As a further alternative to the use of fuse 20, restricted section 12 may be fabricated from a metal or alloy of suitable metals, such as PdAl, or other suitable material combination that conducts current and upon an overcurrent under fault conditions heats up and ignites in the fashion of an exothermic fuse and rapidly burns to then ignite material 18. Thus, restricted section 12 serves as both current conductor under normal operation and fuse upon a fault. With this construction, the cross section will be greater than that of a conventional restricted section 12 because of higher electrical resistivity.

Figure 3:
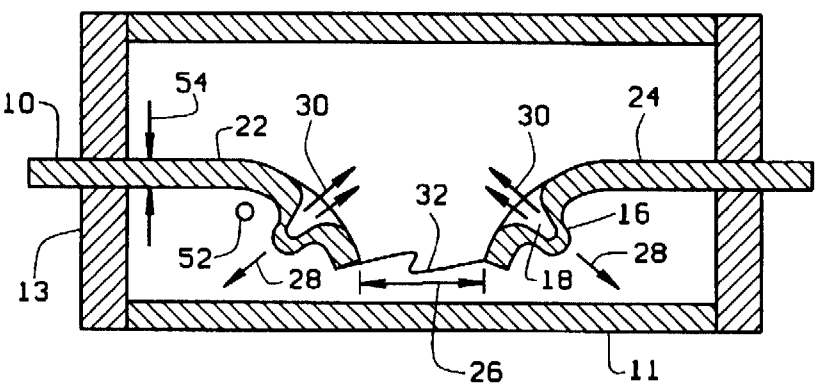
FIG. 3 is a side cross section view of a fuse showing propulsion of the fuselink segments away from each other during a fault condition.

Referring now to FIG. 3, shown are the two segments 22, 24 of fuselink 10 being propelled 28 apart 26 by burning 30 exothermic material 18. One end of segment 22 is fastened to end cap 13 and so well 16 describes a curved path, which, in general, is in the general form of an arc. Arc 32 between segments 22, 24 is seen as being stretched distance 26 and thus increasing in impedance. When spacing 26 between segments 22, 24 reaches a critical distance, dependent upon the applied voltage and other factors such as the presence of arc quenching gases, the arc is extinguished. At suitably high currents and voltages an arc chute may be incorporated. With proper design and material selection, arc clearing time in the hundreds of microseconds may be obtained. This provides for lower let through energy ($I^2t$) during the arcing phase with consequent reduced potential for sensitive equipment damage.

With the present invention, the substantially lower let through energies ($I^2t$) arising from sub-millisecond arcing times result in lower pressure build-up compared to conventional fuses. In this manner much of the pressure build-up due to the exothermic reactions of materials 18, 20 can be compensated for, with the end result that internal housing pressures may be comparable to conventional fuses. Under conditions of low fault currents where conventional fuses have relatively high $I^2t$ energy dissipation due to prolonged arcing, internal housing pressures in the present invention may be substantially less. The range of expected internal housing pressure variations will be less for the present invention than for comparable conventional fuses.

The thickness 54 of fuselink 10 is generally small for currents up to about 10A, for example, 0.1–0.4 mm. This coupled with the general softness of fuselink 10 material, usually copper, aluminum or silver, makes link 10 very pliant and easy to flex or curve about thickness 54, that is, around axis 52. Fuselink width 53, FIG. 2, which is relatively large, e.g. 5–20 mm, is substantially unaffected by the flexing or curving movement and adds relatively little to exothermic material 18 requirements. In this manner, minimal exothermic material 18 is required for propulsion of segments 22, 24 with the result that the pressure build-up in housing 11 is less than the prior art where multiple explosive means are generally used to disintegrate, burn or mangle the fuselink at, in general, multiple points along its length. The exothermic material is designed for a suitable impulse or a controlled burn to act as a propellant. There is substantially no change in the width 53 and thickness 54 cross sectional geometry, here shown as rectangular, before, during and after a fault. The flexing or curving of fuselink 10 during propulsion by exothermic material 18 is predominantly along its length. This comprises minimal energy expenditure and minimal pressure build-up. It is anticipated that less exothermic material 18 and resultant energy release will be involved than that described in the prior art for explosively activated fuses.

Figure 4:
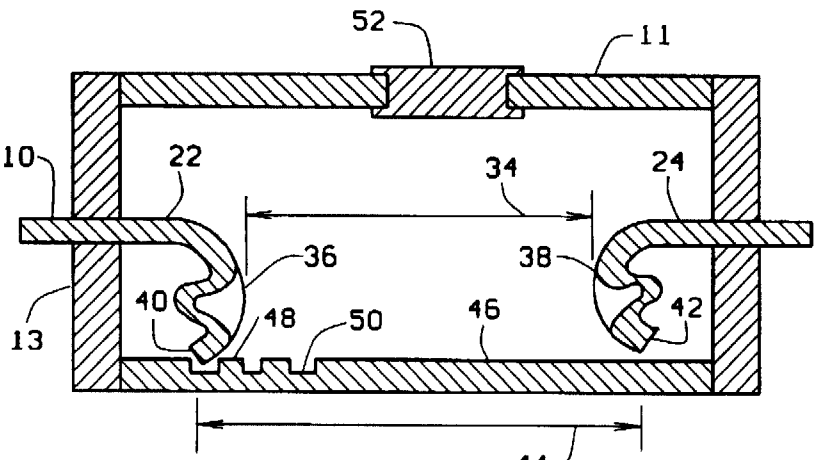
FIG. 4 is a side cross section view of a fuse showing the position of the fuse segments after fault clearance.

Referring now to FIG. 4, shown are the final resting positions of fuselink 10 segments 22, 24, now spaced apart distance 34. Distance 34 may be selected such that failure of one of propulsion material 18 to ignite still provides sufficient spacing, that is, half of 34, such that adequate voltage isolation is obtained and the arc 32 is extinguished and does to re-ignite. Segments 22 and 24 have the flat faces 36, 38 of cold strip metal facing each other thereby minimizing the electric field strengths, there being no hot, sharp edges 40, 42 opposing each other. Also, the leading edges 40, 42 of melted restricted section 12 are shown facing away from each other and spaced 44 apart, which is further apart than faces 36, 38 with consequent lower electric fields between 40, 42.

The geometry and travel path of segment 22 has been designed to cause tip 40 to wedge itself against the inside surface 46 of envelope or housing 11. This further serves to quench the hot tip 40 to further insure arc extinction in addition to the effect the mechanical action of forcing tip 40 against surface 46 has on extinguishing the arc. In addition, a layer of material 48 that produces arc quenching gas may be deposited on surface 46 such that when hot tip 40 strikes surface 46 coated with material 48, arc quenching gases are produced accompanied by an increased cooling rate of hot tip 40. To improve the locking action of tip 40 onto surface 46, a predetermined surface geometry such as corrugations 50 may be employed. This is also useful in environments of high shock and vibration. When corrugations 50 are extended the length of housing 11, improved electrical insulation is obtained. Corrugations 50 may also be on the external surface of housing 11.

As an alternative, segment 24 is shown as having been simply driven into an arc shape with tip 42 not contacting surface 46. In case of high internal pressures being developed from the burning of material 18, relief valve 52, which may be a disc of silicon rubber, and which may be equipped with a pressure responsive relief hole, may be installed.

Figure 5:
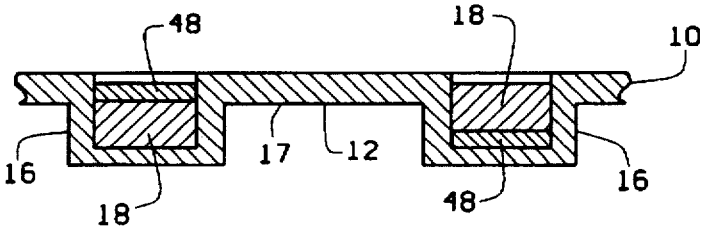
FIG. 5 is a partial cross section view of a fuselink with exothermic containment and material for arc quenching.

Referring now to FIG. 5, shown are containment wells 16 in fuselink 10 having arc extinguishing material 18 incorporated into wells 16. First well 16 shows material 48 in the bottom whereas second well 16 has material 48 at the top. First well 16 produces arc extinguishing gases after material 18 has burned a specified time whereas second well 16 produces arc extinguishing gases substantially immediately upon ignition of material 18. Alternatively, materials 18 and 48 may be mixed for continuous production of arc extinguishing gases. This may be further refined by varying the ratio of mix of materials 18 and 48 with depth to obtain a varied and predetermined arc quenching gas production during the burning period of material 18.

Figure 6:
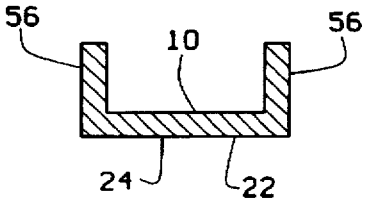
FIG. 6 is a face on cross sectional view of a fuselink with bent up edges for controlled axis of rotation.
Figure 7:
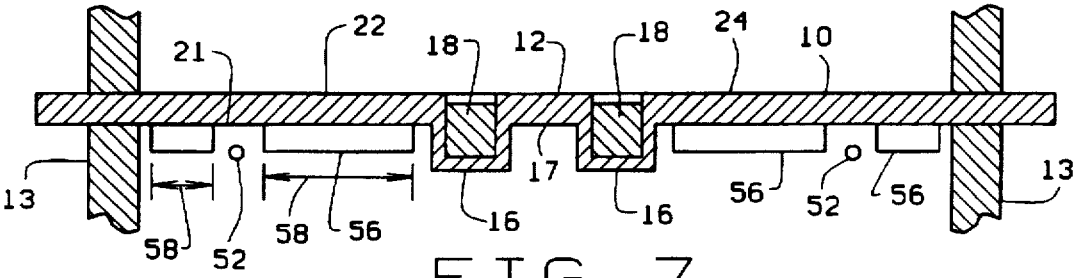
FIG. 7 is a longitudinal cross sectional view of a fuselink with bent up edges for rigidity.

Referring now to FIGS. 6 and 7, shown is fuselink geometry that permits segments 22, 24 to describe predetermined paths when propelled by material 18. -Segments 22, 24 of fuselink 10 have edges 56 bent up, or geometrically distorted, for a predetermined length 58 resulting in rigid construction thereby ensuring that the axis of rotation 52 is along section 21 on segments 22, 24. Section 21 acts as a hinge for segments 22, 24 to bend or pivot about. The production of fuselink 10 with wells 16 and bent edges 56 may all be done in a single stamping operation. Alternatively, flat fuse links 10, with arbitrary planar geometries may be made by chemical milling with wells 16 and bent edges 54 stamped in a secondary operation. In general, the cross sectional area of fuselink 10 preferably remains substantially constant to maintain constant resistance except for the restricted section 12. All embodiments of the present invention may incorporate the structures illustrated in FIGS. 6 and 7.

Figure 8:
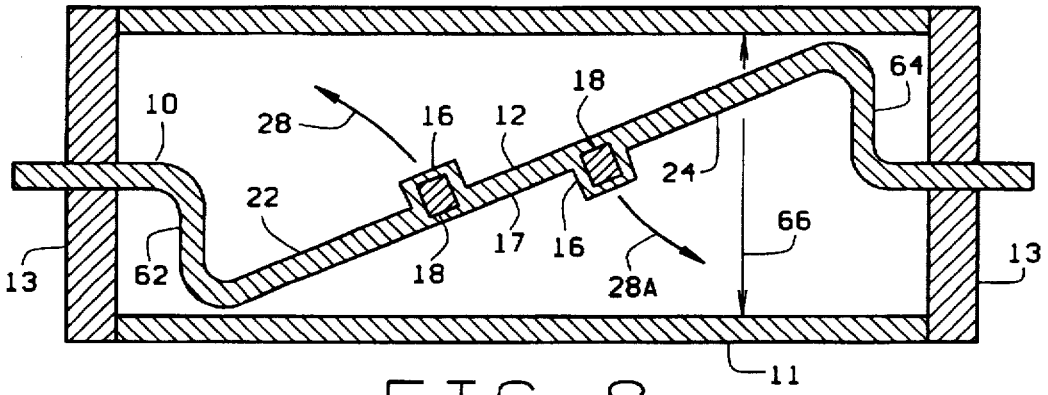
FIG. 8 is a fuse with the fuselink bent in a general "S" shape for stress relief and efficient use of fuse housing space.

Referring now to FIG. 8, shown is an alternative geometry for fuselink 10. Fuselink 10 is shown in a generally "S" shaped configuration with the restricted section 12 approximately in the middle. Sections 62, 64 of segments 22, 24 serve the dual purpose of expansion relief, thereby minimizing thermal fatigue and to provide the maximum economy of space in that when segments 22 and 24 are propelled by exothermic material 18, substantially the full height 66 of housing 11 may be used thereby obtaining maximum final spacing, that is, higher voltage isolation, between segments 22, 24 after fault clearance. Wells 16 are shown on opposing surfaces of fuselink 10 in order to propel segment 22 in direction 28, and to propel segment 24 in opposing direction 28A, both of which provide for maximum final spacing between segments 22 and 24. This provides for a very compact structure and is suitable for use with semiconductors or high voltage applications.

Figure 9:
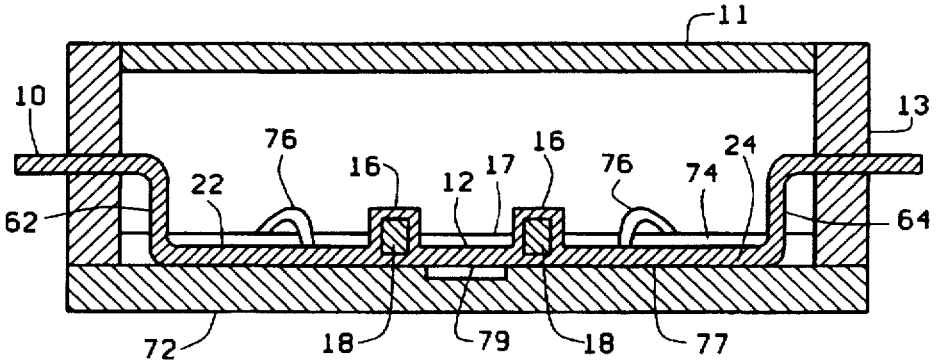
FIG. 9 is a side cross sectional view of a cool operating fuse with a heat transfer plate for the fuselink to be pressed against.
Figure 10:
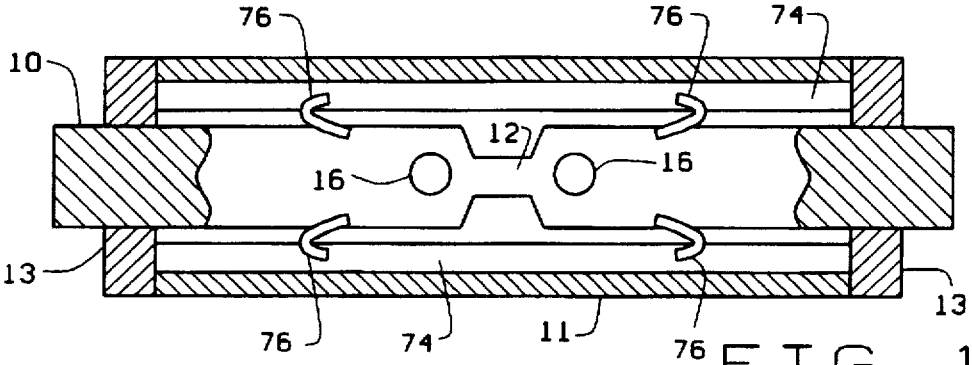
FIG. 10 is a top down cross sectional view of FIG. 9.
Figure 11:
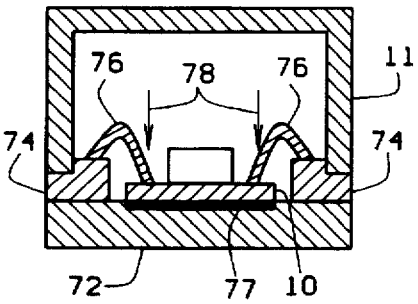
FIG. 11 is a face on cross sectional view of FIG. 9.

Another embodiment of the present invention is shown in FIGS. 9, 10 and 11 and is particularly suited for use in applications where heat dissipated in fuselink 10 must be efficiently removed. Referring now to FIG. 9, insulating housing 11 incorporates at least one dielectric surface that has moderate to high thermal conductivity, here shown as plate 72 fastened to dielectric housing 11. For moderate thermal conductivity $Al_2O_3$ may, for example, be used as plate 72. For high thermal conductivity BeO, SiC or AlN ceramics may, for example, be used. Housing 11 may be completely made of the above ceramics or other suitable dielectric material.

Fuselink 10 has, for example, restricted section 12 generally centered in housing 11. Fuselink 10 is shown as entering a first end cap 13 approximately in the center and then bending approximately 90° or other suitable angle and being directed toward plate 72. In proximity to plate 72, link 10 is bent about 90° or other suitable angle on a suitable radius to then lie substantially parallel to plate 72. Upon reaching the vicinity of the opposing second end cap 13, link 10 again goes through two successive 90° or other suitable angle bends to exit out approximately centered from the second end cap 13 as shown. As in FIG. 8, sections 62, 64 of link 10 serve as expansion joints and permit use of the full height of housing 11 for segments 22, 24 travel during fault clearance. Plate 72 may be prepared with a small recess 79 to ensure that restricted section 12 operates properly and is not inappropriately cooled by plate 72. Plate 72, housing 11 and end caps 13 may be joined and sealed with suitable adhesives or other means. FIGS. 1 to 4 could employ similar joining means.

Referring now to FIG. 11, shown is plate 72 having plastic side rails 74 molded on to it. Rails 74 may have periodically spaced holding means 76 incorporated during the molding operation. Holding means 76 may be suitably formed beryllium copper strips 76 applying suitable force 78 to hold link 10 against plate 72 to ensure proper heat transfer. Strips 76 also serve to dampen vibration perpendicular to the surface of plate 72. The force 78 exerted by strips 76 on link 10 is overcome by the propulsion force 30 (FIG. 3) of exothermic material 18 upon a fault condition whereupon normal fault clearing operation, as previously described, ensues. Strips 76 may be oriented or twisted in such manner that they readily and with minimum resistance disengage from link 10 as it is propelled from plate 72 under fault conditions. To further enhance heat transfer, a suitable heat transfer medium such as thermal grease 77 may be employed to join link 10 and plate 72 opposing surfaces. In general, thermal grease is kept away from material 18 and restricted section 12.

Referring again to FIG. 10, shown are multiple strips 76 for holding link 10 against plate 72 for predetermined heat transfer. Thermal cycling of link 10 causes it to expand and contract. With plate 72 as a heat sink the expansion of link 10 is kept to a minimum because of minimal temperature excursions. Referring again to FIG. 9, what expansion of link 10 there is, is taken up by sections 62, 64 with minimal stress to link 10. Strips 76 also serve to ensure that adequate thermal contact between link 10 and plate 72 is maintained during shock, vibration, expansion and contraction. Referring again to FIG. 11, since strip 76 pressure 78 is substantially orthogonal to link 10 expansion, link 10 is free to expand and contract with no adverse interaction. If heat sink compound 77 is used between link 10 and plate 72, force 78 from strip 76 helps maintain intimate contact during thermal cycling.

Referring again to FIG. 9, exposed exothermic material 18 is shown in close proximity to and facing plate 72. This enclosing of material 18 provides greater efficiency in propulsion of segments 22, 24. The surfaces of plate 72 opposing material 18 may be coated with a material, such as boric acid, which will generate arc extinguishing gases when heated by the burning material 18. For low voltage applications, for example, to about 2000 V, the external surface of plate 72 may be attached to a suitable heat sink, e.g. a chassis. For high voltage use, the fuse may be enclosed in a container with a suitable dielectric heat exchange fluid, such as transformer oil, that can cool plate 72 by convective or forced flow heat transfer.

Figure 12:
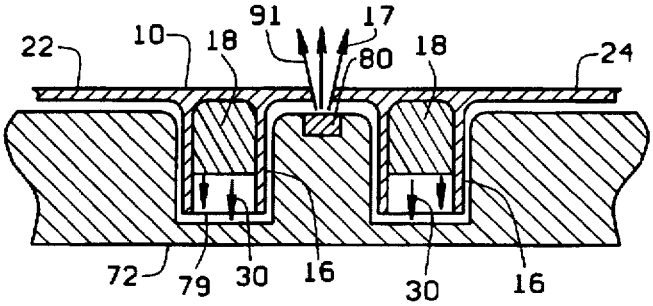
FIG. 12 is a top down cross section of a high current fuse with a substantially constant cross section fuselink, explosive cutting means for the fuselink and associated circuitry for detecting a fault and triggering the fuselink cutting means.

Referring now to FIG. 12, shown is plate 72, which in addition to ceramic, may also be a suitable high temperature plastic or other insulating material, prepared with cavities 79. Exothermic material 18 containment wells 16 have a reversed geometry of wells 16 shown in FIG. 9. The opening of well 16 in FIG. 9 is substantially co-planar with the plane of fuselink 10, whereas well 16 in FIG. 17 has the opening below the plane of fuselink 10. Referring again to FIG. 12, wells 16 are preferably a close fit into cavities 79 with just sufficient clearance to be ejected without interference upon ignition of exothermic material 18. Cavities 79 serve to confine the propulsion gases generated by exothermic material 18 thereby generating and maintaining higher gas pressures until wells 16 of link segments 22, 24 are propelled clear of cavities 79. Much like a bullet being propelled down a barrel, more efficient use of exothermic material 18 is obtained as compared, for example, to FIGS. 9–11. Fault response in FIG. 12 is shown with cutting charge 80, as in FIGS. 13, 14 with charge 80 then igniting propulsion material 18 by suitable fuse means, such as fuse 20 in FIG. 1. All embodiments of the present invention may incorporate the design concepts of FIGS. 9, 10, 11 and 12.

Figure 13:
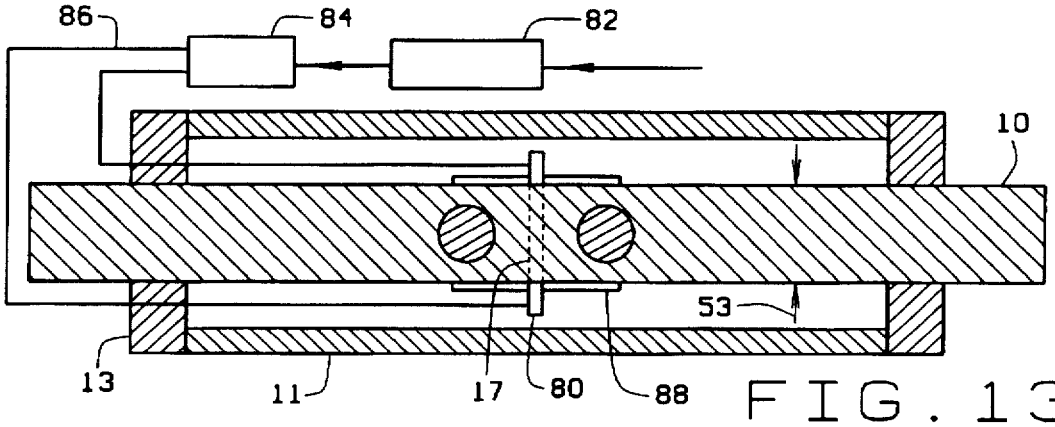
FIG. 13 is a side cross section view of FIG. 12 illustrating the action of the fuselink cutting charge.
Figure 14:
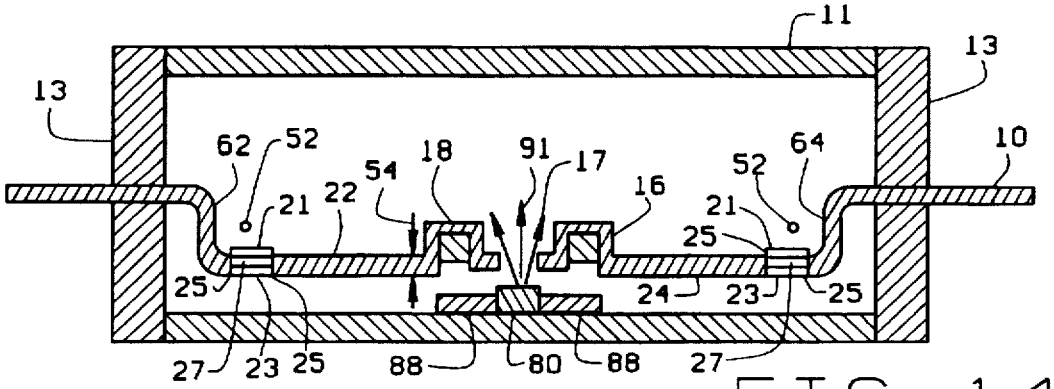
FIG. 14 is a side cross section view of the fuselink segments being propelled apart and the arc interacting with the cold cathode plates of the arc chute.
Figure 15:
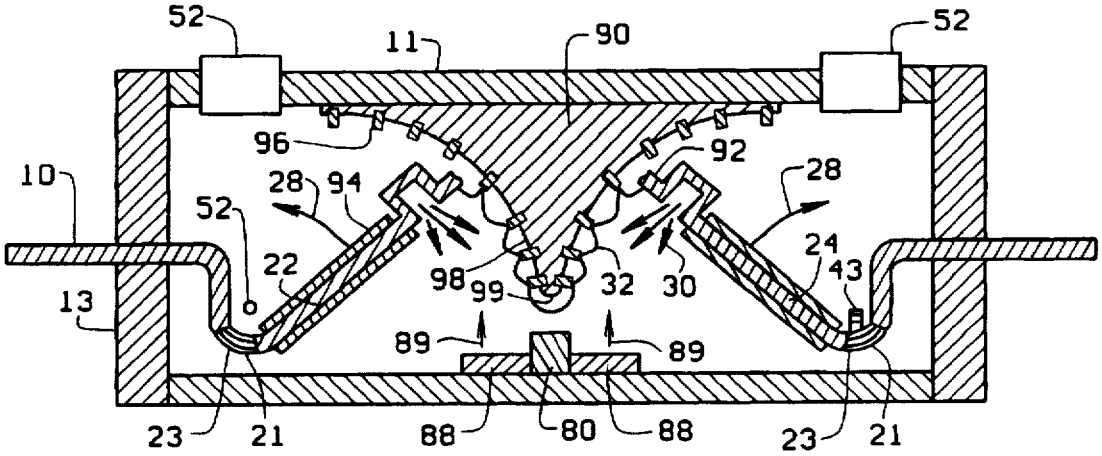
FIG. 15 is a face on view of the arc chute of FIG. 14 illustrating a preferred configuration of cold cathode plates.

For high current operation, a further embodiment of the present invention is shown in FIGS. 13, 14, and 15. To operate at high currents, for example, the thousand ampere range, much larger fuselink 10 cross sections are required to maintain reasonable fuselink temperatures due to $I^2R$ losses during normal operation. At these high currents, restricted section 12 construction is generally no longer practical.

In FIGS. 13–15 the fuselink 10 cross section area is preferably substantially constant along its length. To provide a rupture in the fuselink at severance section 17 and between the exothermic charges 18, a cutting charge 80 is provided, as used in, for example, explosive bolt cutters. A fault sensing circuit 82 determines a fault condition and commands a trigger circuit 84 to send current down the wire 86 to detonate the cutting charge 80 which then cuts 91 the fuselink 10 in two, and then with a suitable time delay method 88, ignites 89 the propulsion material 18 to drive the fuselink segments 22, 24 apart as in FIGS. 1 to 4. Alternatively, instead of separate charge 18 ignition means 88, part of the cutting charge gases 91 may be suitably diverted to ignite propulsion charge 18. The chemistry of the ideal cutting explosive 80 is such that the gases 91 emitted are arc 32 cooling and de-ionizing. Since arc 32 temperatures range from 10,000 to 15,000° K, almost any gas source will be cooler. In this manner, even as an arc 32 is struck between the severed fuselink segments 22, 24 current limiting de-ionizing gases are present to limit the arcing current compared to an arc in air. As the fuse segments 22, 24 are propelled apart, the de-ionizing gases from the propulsion charges 18 pick up where the cutting charge 80 gases 91 left off and continue the current limiting function coupled with the arc chute 90 effects. In general, the arc 32 will remain locked on the hot tips 92 of fuselink segments 22, 24 as long as any other potential path does not have a lower impedance. If necessary, for example, the fuselink behind the containment wells 16, which run relatively cool, may be coated with an insulator 94, for example, high temperature (>500°) silicon rubber or plastics, or saureisen cement to insure that the arc 32 does not propagate along segments 22, 24.

Referring again to FIG. 14, at high currents, typically several hundred to several thousand amperes, the thickness 54 of fuselink 10 may range, for example, from one to ten millimeters. At increasing fuselink 10 thicknesses 54, fuselink 10 rigidity increases which requires an increase in exothermic material 18 to propel fuse segments 22, 24 about the axis 52 of rotation.

A flexible section 21 of fuselink 10 acting as a hinge may be provided in the proximity of pivot point 52. It may, for example, comprise a plurality of thin laminations 23 of metal such as copper or aluminum, bonded 25 metallurgically, such as by brazing, at each end to fuse segments 22, 24. In general, the cross section of flexible section 21 is comparable to that of fuselink 10 so as to provide substantially the same electrical resistivity. Laminations 23 would have width 53, and, for example, at a thickness of 0.5 mm each, then ten laminations 23 would be required to equal a 5 mm thickness of fuselink 10. To further enhance flexibility of section 21, a small gap 27, for example, 0.1 mm may be provided between adjacent lamination 23. This can minimize friction and interference between adjacent laminations 23 during bending and rotation about axis 52. Each lamination has a slightly different radius of curvature about pivot axis 52. In general, the stiffness of fuselink 10 when made thick, such as 5 mm, for high current use is such that bending up the edges 56 as described in FIGS. 6,7 is not necessary to provide rigidity to confine bending to axis 52.

To provide further control of the curved path traversed by arcing tips 92 of fuselink segments 22, 24, that is, to ensure that tips 92 remain in predetermined proximity to arc chute plates 96 during movement 28, restricting means, such as bar 43 is placed in proximity of flexible section 21 to constrain any undesirable movement of fuselink segments 22, 24. Bar 43 may be attached, for example, to housing 11 or base plate 72.

Referring again to FIG. 15, to enhance high current fault clearing characteristics, the fuse has incorporated an arc chute 90. The arc chute 90 may combine the beneficial attributes of both the insulated plate arc chute and the cold cathode arc chute used in power circuit breakers and may, for example, have well-known "U" or "H" geometries. The arc chute 90, made of an insulating material such as ceramic or plastic, has the surface closest to the arc path prepared with cold cathode plates 96. The cold cathode plates 96 may be designed in a manner similar to that for circuit breakers and may, for example have well-known "U" or "H" geometries, or may be short strips of metal as illustrated. The surface 98 of the arc chute 90 in the vicinity of the cold cathode plates 96 may be coated, impregnated or composed of material that in the presence of arc 32 generates arc cooling and/or deionizing gases or vapors.

In general, plates 96 may protrude from the surface of arc chute 90 sufficiently so as to shield or mask the insulating surface 98 of arc chute 90 between plates 96 from the line of sight deposition of vaporized metal from fuselink 10. Because a fuse is a one time device and need not endure numerous fault cycles as required of circuit breakers and other switchgear, the design and cost parameters for the arc chute and cold cathode plates are much less stringent than would be for circuit breakers.

During arcing, each plate 96 provides a cathode and anode voltage drop, typically greater than 20V for each restriction, for current limiting. In addition to the above, the chute 90 provides arc lengthening properties. Furthermore, the arc cooling and arc de-ionizing gases generated from material in the path of the arising arcs from the chute surface further serve to limit current, that is, reduces let-through energy ($I^2t$).

For profuse generation of arc cooling and/or arc de-ionizing gases, vents may be provided. In FIG. 15 shown are, for example, two vents 52, one adjacent each end cap 13. Since generation of arc cooling/de-ionizing gases are generally in the middle of the fuse, pressure waves are directed towards both ends of the fuse body 11 and will tend to predominately drive out air, and with continued generation of gases the air residue becomes small leaving behind gases better suited to withstand restrikes. The vents may be of silicone rubber with outwardly moving flaps which are glued or molded in place such that a predetermined internal fuse pressure ruptures the adhesive seal and vents gas. Upon approaching equilibrium pressure, the elastic flap closes sealing in the remaining gases which are predominately those generated for arc de-ionization and cooling. An ideal gas is $SF_6$ which may be absorbed in suitable porous media and released by the heat of the arc. Both the exothermic propellant and cutting charge may employ $sf_6$ as the de-ionizing gas.

When used with restricted section fuselinks, such as semiconductor fuses shown in FIGS. 1–11, the arc chute 90 requires no special protection. However, when used with high current fuselinks which employ a cutting charge 80 to cut the fuselink 10 in half, then the tip 99 of the arc chute 90 opposing the cutting charge 80 is subject to residual hot cutting gases 91. This may be put to good use by composing the tip 99 of the arc chute of a material that upon decomposing under the residual hot gases 91 of the cutting charge 80 generates arc cooling and/or de-ionizing gases at essentially time zero. This further reduces let-through energy ($I^2t$). In addition, as shown in FIG. 15, the propulsion charge gases 30 are directed at least partially toward the arc 32 on the arc chute 90 serving to further disrupt the arc 32 in a manner similar to air blast circuit breakers. This may be augmented with the addition of deionizing gases in propulsion gas stream 30.

Figure 16:
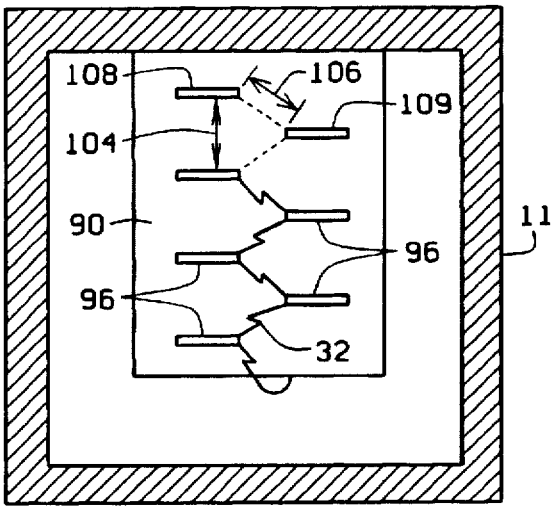
FIG. 16 is a partial cross section of a fuselink where the fuselink material participates in the exothermic reaction for fuselink segment propulsion.

Referring now to FIG. 16, shown is a face on view of arc chute 90 having cold cathode plates 96. The two staggered columns 108, 109 of plates 96 serve to effectively increase the arc 32 length and increase the number of plates 96 for a given arc chute 90 geometry while maintaining spacing 104, 106 between plates such that adequate electrical insulation is provided between adjacent plates 96. Though two columns 108, 109 of plates 96 are shown, more may be employed.

Again referring to FIG. 16, the spacing 104 between adjacent plates 96 in column 108 is greater than the spacing 106 between adjacent plates 96 of columns 108 and 109. Spacing 104 is sufficiently greater than spacing 106 such that when arc 32 strikes across spacing 106 there is no tendency for the arc 32 to redirect its path across spacing 104. The impedance of path 104 between plates 96 is greater than the impedance of path 106 which ensures that the arc 32 follows a zig-zag path as it progresses up the plates 96 of columns 108, 109. The long arc 32 zig-zag path and the increased number of plates 96 serves to further increase the arc voltage drop thereby improving current limiting and an associated reduction in damaging let through energy ($I^2t$). When employing multiple columns of plates 96, combinations of suitable plate 96 geometries and arc 32 current interactions, similar to that employed in power circuit breakers, may be obtained such that the arc 32 rapidly shifts among the plates 96. This ensures that the arc 32 does not dwell long enough on one plate to cause overheating. This is particularly useful at high fault currents. The design of arc chutes, for example, of the cold cathode plate and insulated plate types are well-known in art and may, for example, be found in "Circuit Interruption" and cited references, edited by T. E. Browne, Marcel Dekker, NY, N.Y., 1984, herein referred to as Browne. The arc chute 90 design, or other geometries, such as those described or cited in Browne, may be employed in all embodiments of the present invention.

A further embodiment of the present invention is to employ the fuselink 10 as a component of the exothermic reaction. For example, the combination of palladium and aluminum when heated to about 660° C. react exothermically reaching temperatures in excess of about 2800° C. Other combinations of metal, for example, boron and carbon mixtures with titanium and zirconium, may be employed.

Figure 17:
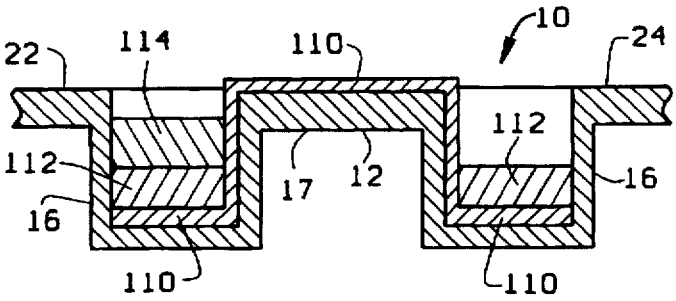
FIG. 17 is a partial cross section view of a fuse base with cavities to make more efficient use of exothermic propulsion material.

Referring now to FIG. 17, fuselink 10 may be made of aluminum. Containment wells 16 have a thin layer of palladium 110 shown affixed intimately to the inside walls of wells 16. A strip of palladium 110 may extend from containment wells 16 to the restricted section 12 to act as a fuse. To provide a source of gas to assist in propulsion, suitable material 112 that decomposes to provide gaseous products at the Pd—Al reaction temperatures of about 2800° C. may be employed and so assist in propelling the fuselink segments 22, 24 apart. To minimize the amount of Pd 110 and gas producing material 112 needed for propulsion, closure of well 16 by various means 114, such as a plug of high temperature silicon rubber or a layer of cured saureisen cement, may be employed. This serves to allow a pressure build-up and discharge or rupture of the closure means 114. The reaction, in accordance with Newton's laws, serves to more efficiently drive fuselink segments 22, 24 apart. The silicon plug 114, or other means, may also serve to seal the Pd 110 and gas forming material 102 from the environment. In general, the thickness of aluminum fuselink 10 preferably exceeds the Pd 110 reaction depth to ensure that a hole does not appear in well 16, and that propulsion of fuselink segments 22, 24 is not affected.

Further adaptation of circuit breaker arc control methods as, for example, described in Browne, include substitution or combination cold cathode metal plates 96 with insulated plates 96, such as ceramic. The arc 32 may be driven into the space between plates 96 by $\bar{J}\times\bar{B}$ forces where it is cooled and confined thereby increasing the arc voltage, for example, to 400V. Methods to obtain the desired force on arc 32 are well-known in the art and include, for example, the use of one or more loops of the current carrying lead wire, as described in Browne. Slot motors may also be employed. Under short circuit conditions, currents in the tens of thousands of amperes may flow, about ten to hundreds of times the rated current. Proper orientation and geometry of the magnetic fields arising from these high currents produce the $\bar{J}\times\bar{B}$ forces to force the arc 32 into plates 96, or to otherwise direct and control it beneficially for rapid fault clearance and lower let-through energy ($I^2t$). Alternatively, permanent magnets, preferably non-conducting may be embedded in arc chute 90 to provide the desired magnetic field.

Figure 18:
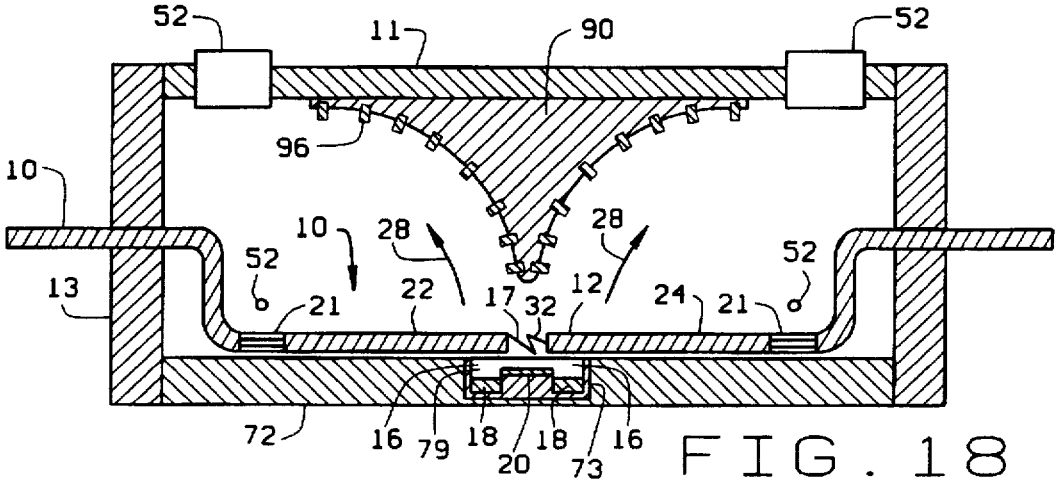
FIG. 18 is a cross-section of a fuse with a restricted section and exothermic material mounted in the fuse housing.

Referring now to FIG. 18, shown is dielectric housing 11 with base 72, which may be a plate, with recess 79 containing at least one but preferably two wells 16 to hold exothermic material 18. Base 72 may be a ceramic which has recess 79 formed during manufacture. Alternatively, base 72 may be a suitable plastic into which structure 73, which may be of suitable heat resistant material such as metal or ceramic, is molded during manufacture to provide recess 79.

Fuselink 10 is provided with severance section 17, such as restricted section 12 such that upon a fault condition, restricted section 12 melts and arc 32 is struck between fuselink segments 22, 24. Arc 32 than ignites fuse 20 in recess 79 which in turn ignites exothermic material 18. The hot gases from exothermic material 18, which are confined in wells 16, provides an upward thrust to propel 28 fuselink segments away from each other. In general, there is a small spacing between restricted section 12 and fuse 20. Fuse 20 ignition of exothermic material 18 is in principle similar to that described in FIGS. 1 to 4. Alternatively, severance section 17 may employ the cutting charge 80 construction of FIGS. 13–15 in FIGS. 18, 19 and 20.

Figure 19:
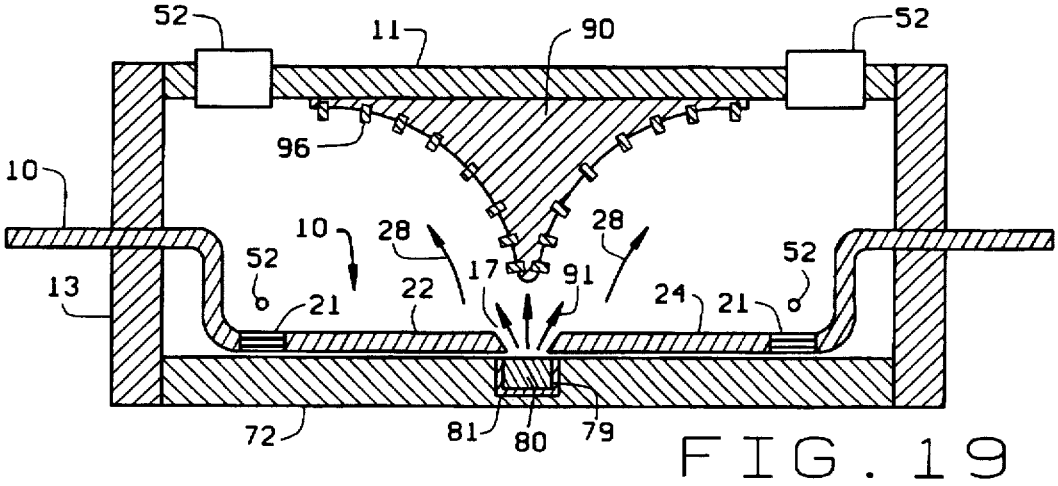
FIG. 19 is a cross section view of a high current fuse with the cutting charge mounted in the fuse housing.

Referring now to FIG. 19, shown is dielectric housing 11 with base 72 which may be a ceramic with recess 79 or it may be a plastic with a metal, ceramic or other high temperature material pre-form 81 inserted into base 72 in which is placed cutting charge 80. Cutting charge 80 is constructed and functions in substantially the same manner as described in FIGS. 13, 14. Fuselink 10 construction, including electrical circuitry 82, 84, 86 is substantiality the same as described in FIGS. 13, 14. Upon a fault condition and detonation of cutting charge 80 and cutting 91 of fuselink 10, fuselink segments 22, 24 are propelled 28 away from each other. In this embodiment, cutting charge 80 is designed to both cut 91 fuselink 10 and propel 28 fuselink segments 22, 24 away from each other. Alternatively, separate propulsion for each of segments 22, 24 may be provided by exothermic material 18 embedded in plate 72 in a manner similar to FIG. 18.

Figure 20:
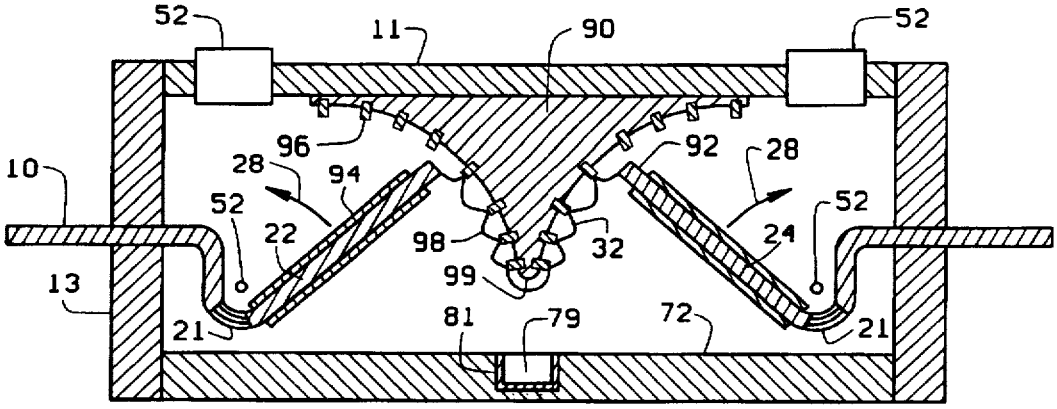
FIG. 20 is a cross section view of fuselink segments of FIGS. 18 and 19 being propelled away from each other with the arc engaged by the arc chute.

Referring now to FIG. 20, shown are fuselink segments 22, 24 being propelled 28 around axis 52 after ignition of material 18 in FIG. 18. The bending of fuselink segments 22, 24 takes place in flexible sections 21. During the movement 28 of segments 22, 24 about axis 52, arc 32 engages plates 96 of arc chute 90 in substantially the same manner as described in FIGS. 15.

In the various described embodiments of the present invention, fuselink 10 is described as being divided into two propelled segments 22, 24. Various alternative configurations are possible, such as a single moving segment or more than two moving segments 22, 24, as might be used at high voltages, such as distribution voltages up to 69 kV. Alternatively, with suitably means to provide current sharing between segment pairs 22, 24, a wide 53 fuselink 10 may be slotted into multiple parallel segments 22, 24 with arc chute 90 extending width 53. Corresponding independent plate 96 sets for each segment pair may be provided to substantially isolate adjacent arcs 32 in adjacent arc chutes 90. Suitable arc 32 sweeping means may also be incorporated.

Figure 21:
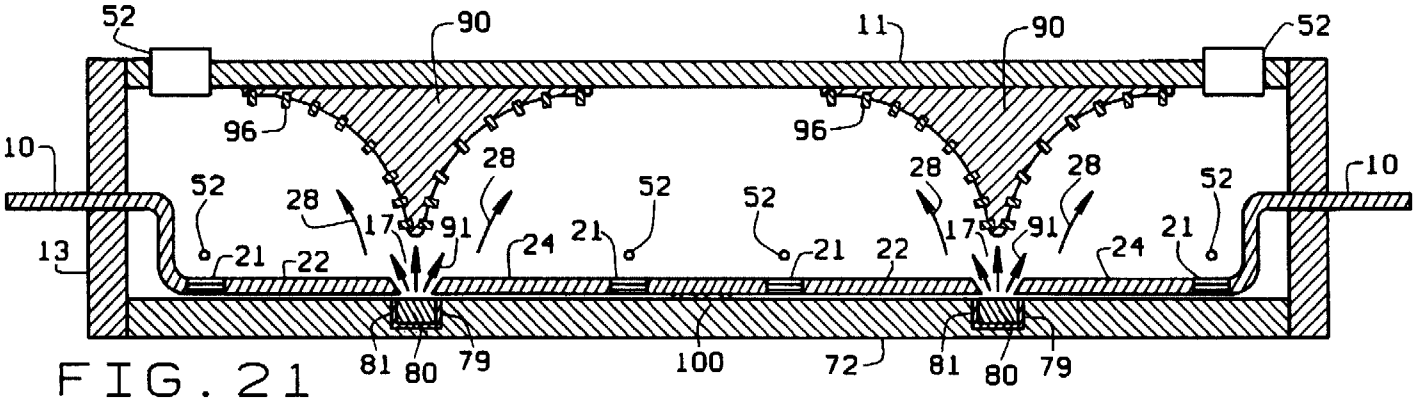
FIG. 21 is a cross section view of multiple seriesed fuselink segments and corresponding arc chutes.

Referring now to FIG. 21, shown is fuselink 10 divided into multiple seriesed segments 22, 24, here shown as two, for high voltage applications, each segment pair having independent severance sections 17, such as restricted section 12 of FIG. 1 or severance section 17 of FIGS. 13, 14 with cutting means 80. Fuselink 10 is attached 100 to base 72 intermediate between segment pairs 22, 24.

Figure 22:
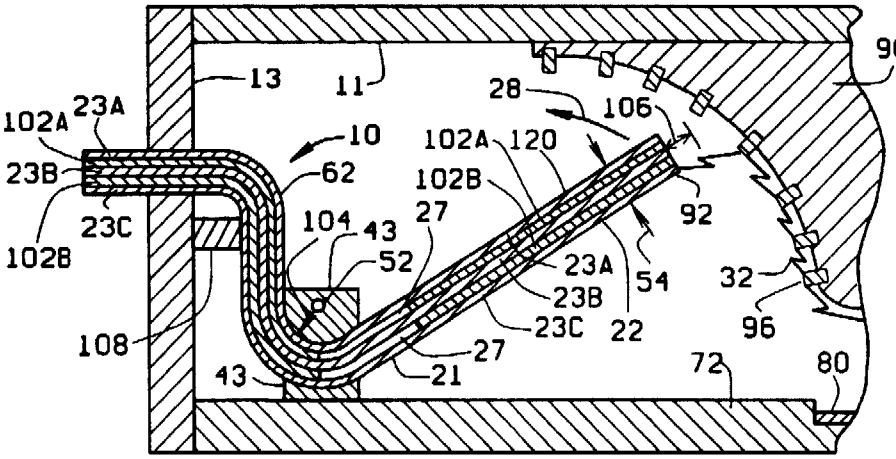
FIG. 22 is a partial cross section view of a fuselink composed of laminated metal strips.

Referring now to FIG. 22, shown is fuselink 10 constructed of strips of thin laminated metal, for example, copper, silver or aluminum. Fuselink 10 comprises, as here illustrated, thin strips 23 A,B and C with intermediate thin strips 102 A,B interposed. Strips 23, may, for example, have a thickness of 1 mm and strips 102 may, for example, have a thickness of 0.1 mm, and therefore comprise a small percentage of the thickness 54 of fuselink 10. Strips 23 may extend the full length of fuselink 10. Strips 102 extend to flexible section 21 from both directions and terminate yielding spacing 27 between adjacent strips 23. Spacing 27 between strips 23 serve to substantially eliminate binding and interference between adjacent strips 23 as fuselink segments 22, 24 pivots about pivot point 52 on radius 104. Each successive strip, from 23A to 23C bend on successively larger radii and thus want to slip relative to each other. When strips 23 are clamped stationary with respect to each other, strips 23 sections in the flexible section bend into the spacing 27 between strips 23 upon pivoting about pivot axis 52. In this manner, minimal energy is required to cause fuselink segment 22 to pivot about axis 52.

Block 43 serves to capture and position fuselink 10 at each end adjacent relief sections 62, 64 and is fixedly mounted to base 72 or housing 11. It is provided with a curved surface of radius 104 centered at the pivot axis 52 for segments 22, 24 to bend about. In this manner, precise control may be obtained over the path traversed by tips 92 of segments 22, 24. Block 43 acts as a stationary hinge about which sections 21 of segments 22, 24 rotate in a precise manner, similar to the manner that the door edge opposing the hinge rotates. This maintains control over the spacing 106 between tips 92 of segments 22, 24 and arc chute plates 96 over the path of travel of tips 92. This maintains substantially uniform arcing characteristics. Brace 108, on the opposing side of sections 62, 64 from block 43 may be provided to further restrict movement of sections 62, 64.

Referring again to FIG. 22, one or both surfaces of strips 23 may be coated with an insulating layer 120, for example, parylene or Teflon. Parylene is a conformal coating that is pinhole free, has a dielectric strength of 7,000V for a thickness of 0.025 mm (0.001") and has a low coefficient, 0.25, of static and dynamic friction. In this manner fuselink 10 is composed of multiple paralleled conductors made up of strips 23 which may be commonly connected electrically at each end. At high frequency operation, currents are substantially on the surface of the conductor 23 and so thick conductors are inefficiently used. The most efficient individual thickness of multiple thin strips 23 is twice the skin current depth thus providing minimum inductance and $I^2R$ losses at high frequency operation for a given thickness 54 of fuselink 10.

Figure 23:
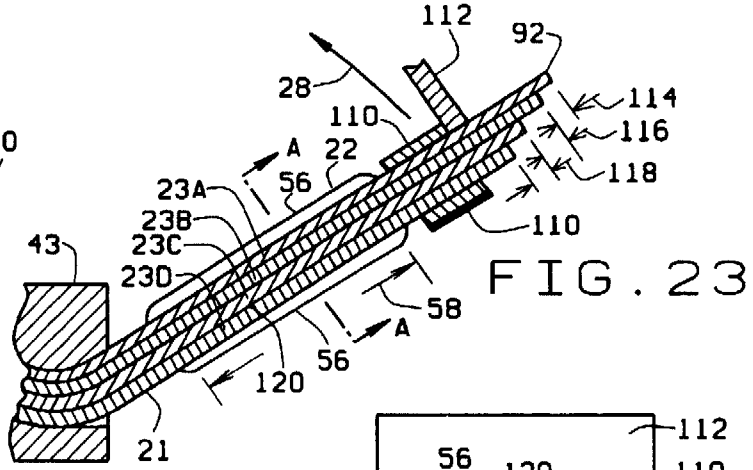
FIG. 23 is a partial cross section of FIG. 22 illustrating alternate construction.
Figure 24:
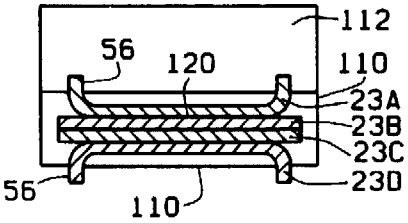
FIG. 24 is a cross section view A—A of FIG. 23.

Referring now to FIGS. 23 and 24, shown is laminated fuselink 10 of FIG. 22 now configured only with strips 23 A, B, C, D. Strips 23 A,B,C,D are substantially continuous for the entire length of fuselink 10. To provide for the relative movement of strips 23 A, B, C, D each with a different radius of curvature, as segments 22,24 pivot about axis 52, they are permitted to slip relative to each other, illustrated as distances 114, 116, 118 as shown at tip 92 of segment 22. At least one surface of opposing of strips 23 may be dialectically coated with, for example, parylene, for lower high frequency current losses as described in FIG. 22. The low coefficient of friction of parylene facilitates the relative sliding movement of adjacent strips 23. Since strips 23 A,B,C,D are mechanically independent, segment 22 may be girdled with strap 110 which confines segments 23 A,B,C,D but permits the desired relative sliding, shown as 114, 116, 118, of strips 23 A,B,C,D with minimal friction. Shield 112 may be employed to provide line-of-sight interception of fuselink 10 material evaporated by cutting charge 80. Strap 110 and shield 112 may be inexpensively fabricated from a stamped and bent sheet metal piece. In general, the time constants of arc clearance, a few milliseconds, are short enough that the molten metal at tips 92 of segments 22, 24 do not harden to inhibit relative strip 23 sliding during segment 22 movement.

Again referring to FIGS. 23 and 24, to maintain predetermined rigidity of multiple superimposed strips 23 of segments 22, 24, the edges of top strip 23A and bottom strip 23D are bent up or rolled over 56 for distance 58, or otherwise geometrically formed to permit predetermined bending characteristics of link segments 22, 24 about hinges 21. That is, the pivoting or bending of segments 22, 24 is substantially restricted to hinge section 21.

For improved high frequency performance thin strips 23 have N−1 sides coated with an insulator 120, such as parylene, where N is the number of strips 23. For example, the surface of 23A opposing surface 23B is coated, the surface of 23B opposing surface 23C is coated and the surface of 23C opposing 23D is coated. Strip 23D is not coated. Thus, all adjacent strips 23 are insulated from each other while the outer surfaces of strips 23A and 23D are uncoated for electrical connections, such as soldering.

Although the invention has been described in conjunction with the appended drawings, those skilled in the art will appreciate that the scope of the invention is not so limited. Various modifications in the selection and arrangement of the various components discussed herein may be made without departing from the spirit of the invention as set forth in the appended claims.

What is claimed is:

1. A fuse comprising:

a housing, a current carrying strip of metal comprising a fuselink enclosed in said housing, each end of which electrically extends through the housing as an electrical connection, at least one first section of said metal strip for severing upon predetermined fault conditions, at least one second section of said metal strip, distanced from said first section, at least one exothermic source that substantially upon severance of said metal strip at said first section is ignited and causes at least one segment of said severed metal strip to be propelled about said second section and an arc chute configured so that a portion of the severed fuselink is located in proximity to said arc chute along the path of movement of the severed fuselink when the fuselink segment is propelled by exothermic material.

2. A fuse in accordance with claim 1 wherein said first section is of high electrical resistivity which melts and severs upon predetermined fault conditions, said first section being composed of at least one of a section having a cross section smaller than that of the remainder of the metal strip and is at least one of a metal and alloy of metals whose electrical resistivity is greater than that of the remainder of the metal strip.

3. A fuse in accordance with claim 1 wherein said first section has positioned adjacent to it an exothermic cutting charge that, upon predetermined fault conditions, is ignited and severs said metal strip at said first section.

4. A fuse in accordance with claim 3 wherein said exothermic cutting charge is ignited by an electrical signal generated by a fault sensing electronic circuit.

5. A fuse in accordance with claim 1 wherein said second section comprises at least one of a metal strip having a hardness less than that of the remainder of the metal strip extending to said first section and a geometrical deformation of the metal strip between said first, and second sections that renders said second section more pliable than that portion of the metal strip geometrically deformed, and said second section is composed of multiple superimposed thin metal strips connected electrically and mechanically at each end to said metal strip, each of the second section thin metal strips having a thickness less than that of the metal strip.

6. A fuse in accordance with claim 5 wherein adjacent multiple superimposed thin metal strips are spaced apart a small distance.

7. A fuse in accordance with claim 1 wherein said fuselink comprises multiple superimposed thin metal strips.

8. A fuse in accordance with claim 7 wherein at least one of opposing surfaces of adjacent metal strips is coated with an insulator.

9. A fuse in accordance with claim 8 wherein said insulator is at least one of a plastic and ceramic.

10. A fuse in accordance with claim 9 wherein said insulator is at least one of Teflon and parylene.

11. A fuse in accordance with claim 1 wherein at least one of said exothermic source is mounted on said fuselink in the proximity of said first section.

12. A fuse in accordance with claim 1 wherein at least one of said exothermic source is located in the proximity of said first section.

13. A fuse in accordance with claim 1 wherein said arc chute comprises at least one of a cold cathode plate arc chute, an insulated plate arc chute, and a combination cold cathode plate and insulated plate arc chute.

14. A fuse in accordance with claim 1, further comprising at least one third section of said metal strip, said third section positioned between said first and said second sections, wherein said third section comprises an additional strip of material that is absent from said first section and said second section.

15. A fuse in accordance with claim 1, further comprising at least one third section of said metal strip, said third section positioned between said first and said second sections, wherein said third section comprises an additional strip of material that is absent from said first section and said second section.

16. A fuse in accordance with claim 1, further comprising at least one third section of said metal strip, said third section positioned between said first and said second sections, wherein said third strip of material comprises a geometrical deformation that provides additional rigidity to said third section over said second section.

17. A fuse in accordance with claim 1 wherein said at least one first section comprises more than one first section, said at least one second section comprises more than two second sections, and said at least one third section comprises more than three third sections.

18. A fuse in accordance with claim 17 further comprising a strap that surrounds said multiple strips, wherein said strap confines said multiple strips but permits relative sliding between said multiple strips.

19. A fuse comprising:

a housing;

a current carrying strip of metal comprising a fuselink enclosed in said housing, each end of said strip of metal extends through the housing;

at least one exothermic material that, upon ignition, severs said metal strip and causes at least one segment of said severed metal strip to be propelled; and an arc chute enclosed in said housing, said arc chute configured so that upon severance of said fuselink, a portion of said fuselink is located in proximity to said arc chute along a path of movement of said severed fuselink when said fuselink segment is propelled by said exothermic material.

20. A fuse comprising:

a housing;

a current carrying strip of metal comprising a fuselink enclosed in said housing, each end of which electrically extends through the housing as an electrical connection, at least one first section of said metal strip for severing upon predetermined fault conditions;

at least one second section of said metal strip, distanced from said first section;

at least one third section of said metal strip, said third section positioned between said first section and said second section, wherein said third section is more rigid than said second section; and at least one exothermic source that substantially upon severance of said metal strip at said first section is ignited and causes at least one segment of said severed metal strip to be propelled about said second section.

* * * * *